US010179275B2

(12) United States Patent
Russocki

(10) Patent No.: US 10,179,275 B2
(45) **Date of Patent: *Jan. 15, 2019**

(54) WORD FORMING GAME AND METHODS TO PLAY THE GAME

(71) Applicant: Martin Russocki, New York, NY (US)

(72) Inventor: Martin Russocki, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/687,907

(22) Filed: Aug. 28, 2017

(65) Prior Publication Data

US 2018/0200612 A1 Jul. 19, 2018

Related U.S. Application Data

(63) Continuation of application No. 14/845,408, filed on Sep. 4, 2015, now Pat. No. 9,744,439.

(51) Int. Cl.

| | |
|---|---|
| ***A63F 3/04*** | (2006.01) |
| *A63F 3/00* | (2006.01) |
| *A63F 9/00* | (2006.01) |

(52) U.S. Cl.

CPC ..... *A63F 3/0423* (2013.01); *A63F 3/00697* (2013.01); *A63F 3/0421* (2013.01); *A63F 9/0098* (2013.01); *A63F 2003/00996* (2013.01); *A63F 2003/0426* (2013.01); *A63F 2003/0428* (2013.01); *A63F 2003/0431* (2013.01); *A63F 2250/1063* (2013.01)

(58) Field of Classification Search

CPC ..... A63F 3/0423; A63F 2003/0426; A63F 2003/0428; A63F 2250/1063; A63F 3/0421; A63F 3/00697; A63F 9/0098

USPC ..... 273/272, 299, 293, 294, 296, 302

See application file for complete search history.

(56) References Cited

U.S. PATENT DOCUMENTS

| | | | | |
|---|---|---|---|---|
| 9,744,439 | B2 * | 8/2017 | Russocki | A63F 3/0423 |
| 2004/0090009 | A1 | 5/2004 | Mortimer | |
| 2008/0258387 | A1 | 4/2008 | Lu | |
| 2012/0252545 | A1 | 10/2012 | Osborne | |

FOREIGN PATENT DOCUMENTS

| | | | |
|---|---|---|---|
| IE | 2012077094 | A1 | 6/2012 |

* cited by examiner

*Primary Examiner* — Benjamin Layno

(57) ABSTRACT

A word-forming game and methods to play the game are disclosed. In one implementation, the method includes obtaining a plurality of game pieces amongst which at least one game piece bears a rotatable indicia on a face thereof, wherein the rotatable indicia depicts a different set of one or more letters when viewed from different viewing orientations. The method further includes linearly arranging the game pieces on a gaming surface to form a first word, wherein the first word includes a first set of one or more letters depicted by the rotatable indicia when viewed from a first viewing orientation, and rotating the at least one game piece bearing the rotatable indicia to form a second word different from the first word, wherein the second word includes a second set of one or more letters depicted by the rotatable indicia when viewed from a second viewing orientation.

13 Claims, 9 Drawing Sheets

600

WORD FORMING GAME AND METHODS TO PLAY THE GAME

This application may contain material subject to copyright or other intellectual property protection. The respective owners of such intellectual property have no objection to the facsimile reproduction of the disclosure as it appears in documents published by the U.S. Patent and Trademark Office, but otherwise reserve all rights whatsoever.

CROSS-REFERENCE TO RELATED APPLICATION

This application is a continuation of U.S. application Ser. No. 14/845,408, filed Sep. 4, 2015, which claims the benefit of U.S. Provisional Application No. 62/046,721, filed Sep. 5, 2014.

TECHNICAL FIELD

The subject matter disclosed herein relates generally to a word forming game having a plurality of game components and methods for playing the game.

DESCRIPTION OF RELATED ART

Word games such as the SCRABBLE®, UPWORDS®, BOGGLE®, and BANANAGRAMS® allow players to create known words from randomly selected or provided letters or combinations of letters. In some of these games, tiles or squares are placed on a playing surface to form interlocking words. In other games, dies having differing letters are used to form various words on a playing surface. In some word games, such as crossword puzzles, letters are filled into a playing surface which, when completed, presents an interlocking arrangement of words.

SUMMARY

This summary is not intended to identify essential features of the claimed subject matter nor is it intended for use in determining or limiting the scope of the claimed subject matter.

In one implementation, a method and system of game play is disclosed. The method includes obtaining a plurality of game pieces amongst which at least one game piece bears a rotatable indicia on a face thereof, wherein the rotatable indicia depicts a different set of one or more letters when viewed from different viewing orientations. The method further includes linearly arranging the game pieces on a gaming surface to form a first word, wherein the first word includes a first set of one or more letters depicted by the rotatable indicia when viewed from a first viewing orientation, and rotating the at least one game piece bearing the rotatable indicia to form a second word different from the first word, wherein the second word includes a second set of one or more letters depicted by the rotatable indicia when viewed from a second viewing orientation.

BRIEF DESCRIPTION OF THE DRAWINGS

Exemplary embodiments of the word game and methods for playing the word game are described with reference to the accompanying figures. In the figures, the left-most digit(s) of a reference number identifies the figure in which the reference number first appears. The same numbers are used throughout the figures to reference like features and components.

Figure 1A:
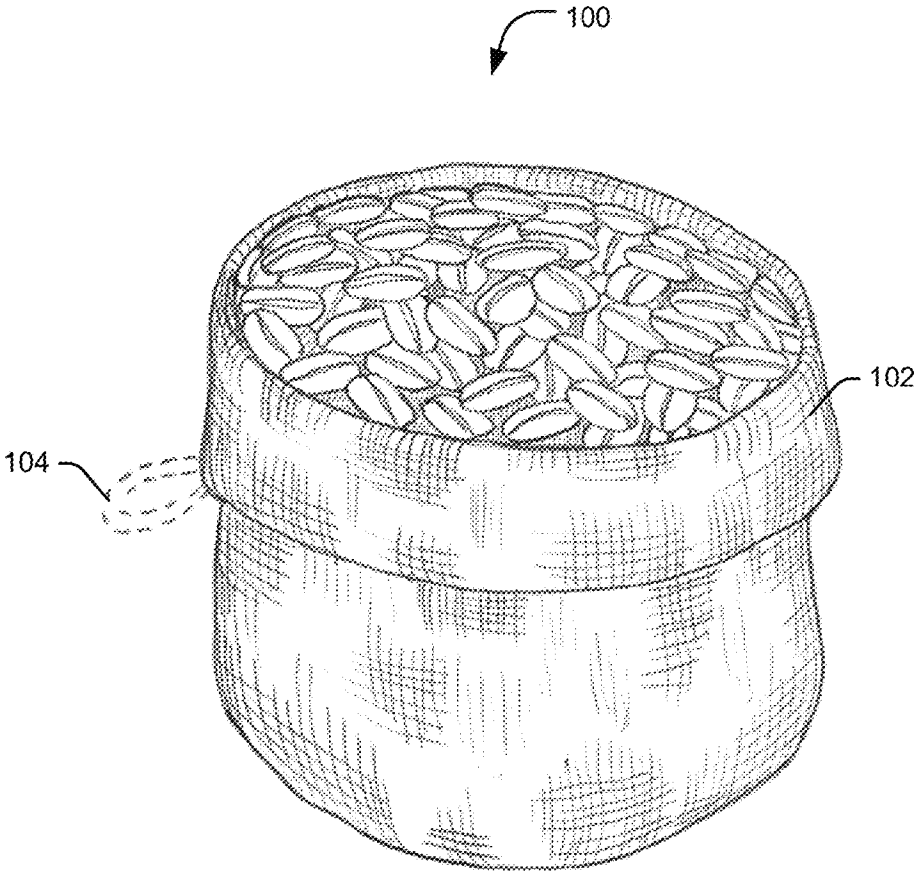
FIGS. 1A-1D are a perspective view, side view, top view, and bottom view, respectively, of an exemplary container, according to an embodiment of the present subject matter.
Figure 1B:
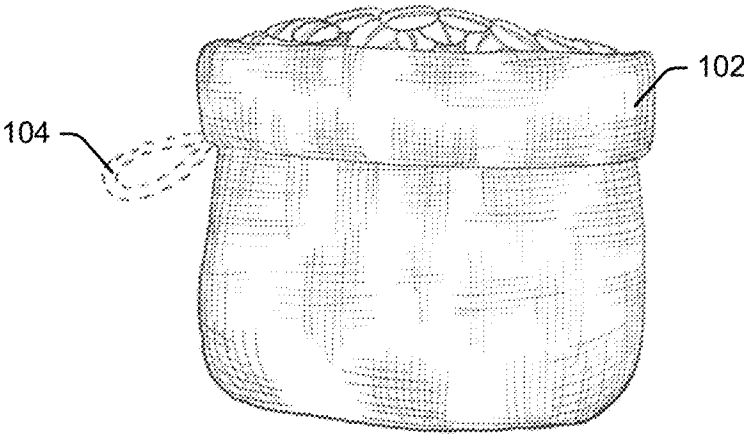

It should be appreciated by those skilled in the art that any block diagrams herein represent conceptual views of illustrative systems. Similarly, it should be appreciated that any flow charts, flow diagrams, state transition diagrams, pseudo code, and the like represent various processes, which may be substantially represented in a computer readable medium and so executed by a computer or processor, whether or not such computer or processor is explicitly shown.

DETAILED DESCRIPTION

Embodiments of a word game and methods to play the game are described herein. While aspects of the described word game and methods to play the game can be implemented in any number of different systems, circuitries, environments, and/or configurations, the embodiments are described in the context of the following exemplary system(s) and circuit(s). The descriptions and details of well-known components are omitted for simplicity of the description.

Reference to an "embodiment" in this document does not limit the described elements to a single embodiment; all described elements may be combined in any embodiment in any number of ways. Furthermore, for the purposes of interpreting this specification, the use of "or" herein means "and/or" unless stated otherwise. The use of "a" or "an" herein means "one or more" unless stated otherwise. The use of "comprise," "comprises," "comprising," "include," "includes," and "including" are interchangeable and not intended to be limiting. Also, unless otherwise stated, the use of the terms such as "first," "second," "third," "upper," "lower," and the like do not denote any spatial, sequential, or hierarchical order or importance, but are used to distinguish one element from another. It is to be appreciated that the use of the terms "and/or" and "at least one of", for example, in the cases of "A and/or B" and "at least one of A and B", is intended to encompass the selection of the first listed option (A) only, or the selection of the second listed option (B) only, or the selection of both options (A and B). As a further example, in the cases of "A, B, and/or C" and "at least one of A, B, and C", such phrasing is intended to encompass the selection of the first listed option (A) only, or the selection of the second listed option (B) only, or the selection of the third listed option (C) only, or the selection of the first and the second listed options (A and B) only, or the selection of the first and third listed options (A and C) only, or the selection of the second and third listed options (B and C) only, or the selection of all three options (A and B and C). This may be extended, as readily apparent by one of ordinary skill in this and related arts, for as many items listed.

The description and figures merely illustrate exemplary embodiments of the word game and methods for playing the game. It will thus be appreciated that those skilled in the art will be able to devise various arrangements that, although not explicitly described or shown herein, embody the principles of the present subject matter. Furthermore, all examples recited herein are intended to be for illustrative purposes only to aid the reader in understanding the principles of the present subject matter and the concepts contributed by the inventor(s) to furthering the art, and are to be construed as being without limitation to such specifically recited examples and conditions. Moreover, all statements herein reciting principles, aspects, and embodiments of the present subject matter, as well as specific examples thereof, are intended to encompass equivalents thereof.

The present subject matter provides tools to develop language skills in an entertaining manner while challenging the imagination and intellect of players. The word making game provides a new and improved system and method of forming words, which may be easily manufactured and marketed. Furthermore, the packaging, such as the container and game pieces, are of durable and reliable construction. The word game and methods for playing the game described herein may find applications in the field of interactive board games and mobile phone applications. Certain embodiments of the word game and methods for playing the game may be configured for and/or implemented by standalone devices (e.g., PDAs, smartphones, tablet computers, laptop computers, PCs).

FIGS. 1A-D and 2A-E illustrate exemplary components of a word game 100 designed to provide one or more players with the tools for forming words or parts of sentences. Physical components of the word game 100 may include, for example, a reusable container 102 for storing a plurality of game pieces. In one embodiment, the container 102 may be a rigid or semi-rigid structure that does not require collapsing or flexibility. In other embodiments, the container 102 may resemble a sack, hereinafter referred to as first container. In such implementations, the sack may be composed of collapsible material, and may include an opening (not shown) and a drawstring 104. The drawstring 104 may be lengthened by pulling, thus allowing the opening to be varied in diameter and shape. In another embodiment, the drawstring may be an ornamental feature and may be used to attach informational tags. In some embodiments, the base of the first container may be configured (i.e., cut, sewn, shaped, traced, patterned, or otherwise formed) to allow the first container to form a substantially cylindrical shape that may allow the first container to stand on its own.

In some implementations, a reusable or other type of sack, as explained above, may be inserted or placed into an interior vestibule of the container 102 (i.e., through an opening (not shown)). The first container may expand to a cylindrical, spherical. substantially cylindrical, or substantially spherical shape with dimensions (e.g., height or diameter) determined by base 104 of the container 102. In other words, the sack-like container may expand to the radius or lateral radius of base 104.

The container 102 may be constructed, fabricated, manufactured, stitched, or otherwise made from natural or synthetic textiles, yarn, or fibers (e.g., cotton, wool, nylon, ripstop nylon, silk, parachute silk, hemp, angora, cashmere, flax, jute, burlap, spandex, polyester, blends, microfibers, and others). Various types of natural, synthetic, or composite textiles, yarn, or fibers may be used for container and drawstring, which are not limited to the examples provided. Further, fibers and microfibers of varying dimensions (e.g., denier or less than one denier in thickness) may be used and are also not intended to limit any implementation. The container 102 may also be constructed of a non-woven material such as a thin plastic film or fiber-based material such as felt.

In another embodiment, the container 102 may be a rigid or semi-rigid structure constructed of a material such as wood, plastic, metal, alloy, composite, etc. Even though the container 102 is shown to be cylindrical in shape, it will be understood that other forms and shapes can be used. The container 102 may include a receiving side with an opening and a removable or hinged top covering the receiving side. Optionally, a lock mechanism may be implemented to secure the top onto the receiving side. A drawstring-like feature 104 may be attached to the rigid container 102 to give an impression of a sack.

Figure 1C:
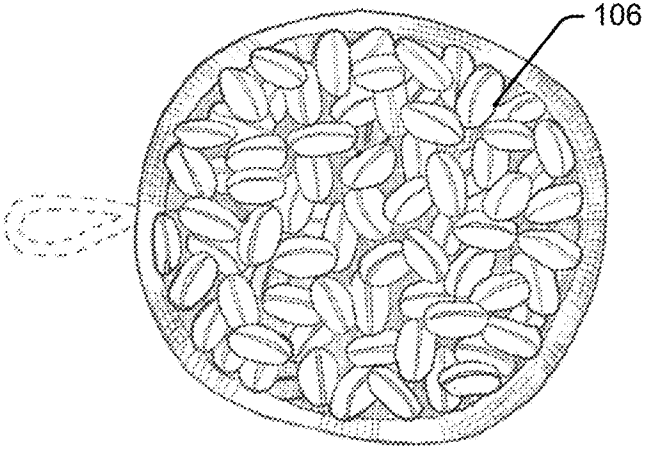
Figure 1D:
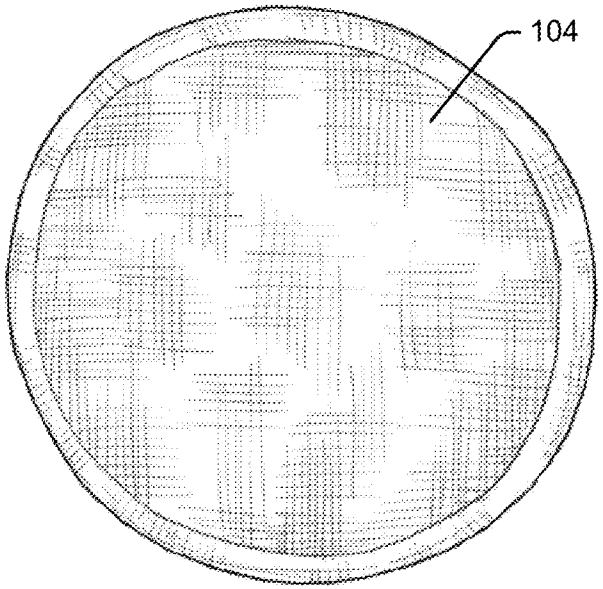

In some embodiments, the container 102 may be rigid or semi-rigid and may be covered in an ornamental way with a flexible material such as those examples described above in reference to flexible containers. Examples include, but are not limited to, jute and cotton. In some examples, bean-shaped structures 106 or any other type of structures may be used to cover or adorn the top of the container 102 as shown in FIG. 1C. In some implementations, the base of the container 104 may include groove-like features or a concave depression shaped to allow for containers, each having a convexly shaped top, to be stacked one on top of the other. It will be understood that the container 102 may be implemented using fewer, more, or different elements than those shown and is not limited to the examples provided.

Figures 2A, 2B, 2C, 2D, 2E:
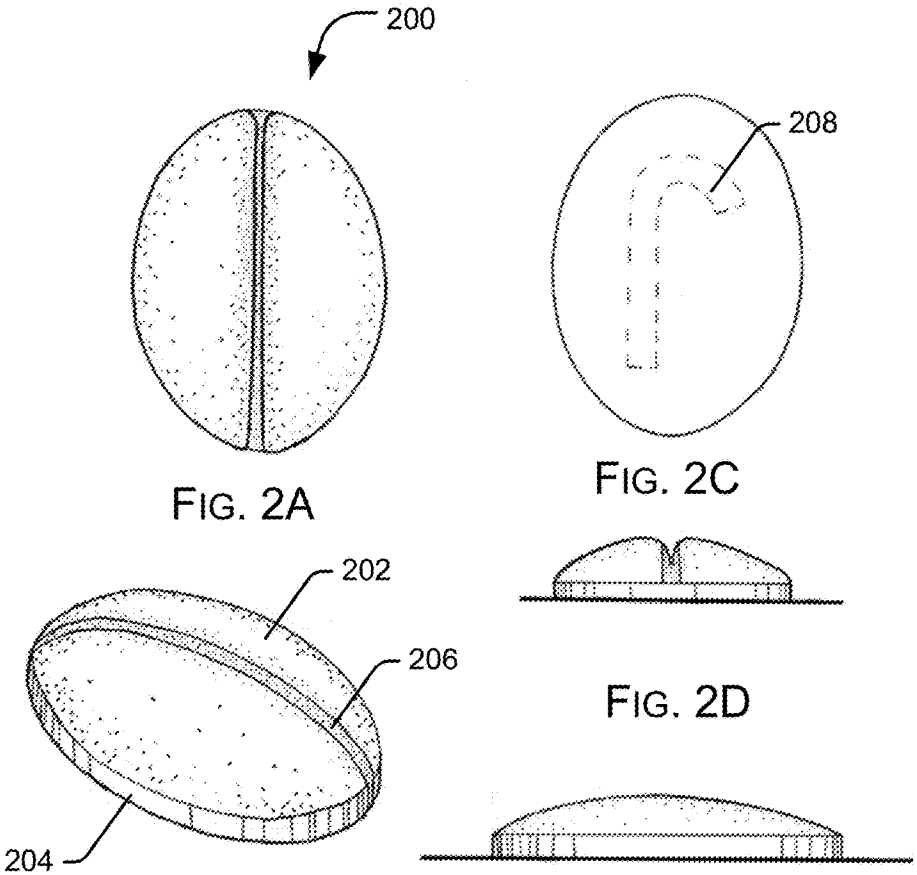
FIGS. 2A-2E are figures to show top view, perspective view, bottom view, side view, and alternate side view, respectively, of an exemplary game piece, according to an embodiment of the present subject matter.
Figure 3:
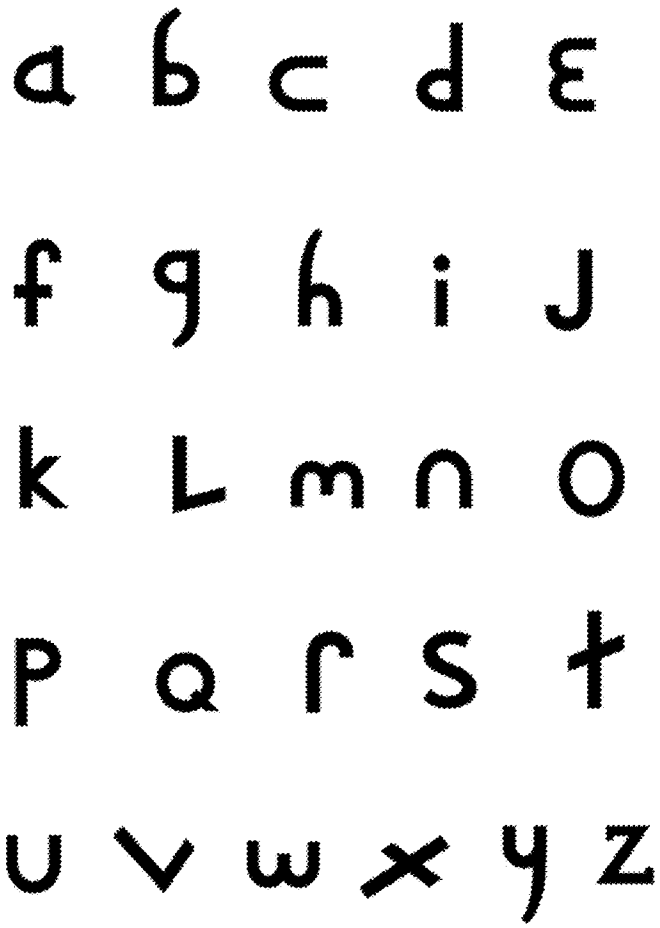
FIG. 3 is a face view of an exemplary typeface, according to an embodiment of the present subject matter.

Container 102, in one implementation, may be used to store a plurality of game pieces. It is anticipated that the game pieces may be constructed having any number of shapes, colors, or textures. For example, in one implementation, the shape of the game pieces may be substantially oval and may thus generally resemble coffee beans or halved coffee beans, as shown in FIGS. 2A-E. In one implementation, each of the game pieces 200, may include a convex or curved surface 202 and a flat surface 204. Some implementations may allow for an indentation 206 to run longitudinally across the convex surface 202. The flat surface 204 may be configured substantially parallel to a plane of a surface on which the game pieces 200 are laid upon, as shown in FIGS. 2D and 2E.

As shown in FIG. 2C, one or more game pieces 200 may bear on one surface, for example, the flat surface 204, a typeface indicia 208. The other major surface, such as an opposing convex surface, may remain clear of any typeface indicia. Each letter of an alphabet may be represented as a typeface indicia on at least one game piece per letter. Same letters may also be represented as typeface indicia on more than one game piece 200. For example, several game pieces may bear representations of more commonly used letters such as 'A' or 'E'. The exact number of game pieces is not critical to the game but may be chosen to supply up to four players with a suggested minimum of eight each, i.e., 46 or more game pieces 200. Some game pieces 200 may also be left intentionally blank to allow a player to use it as a typeface indicia of choice.

Figure 5:
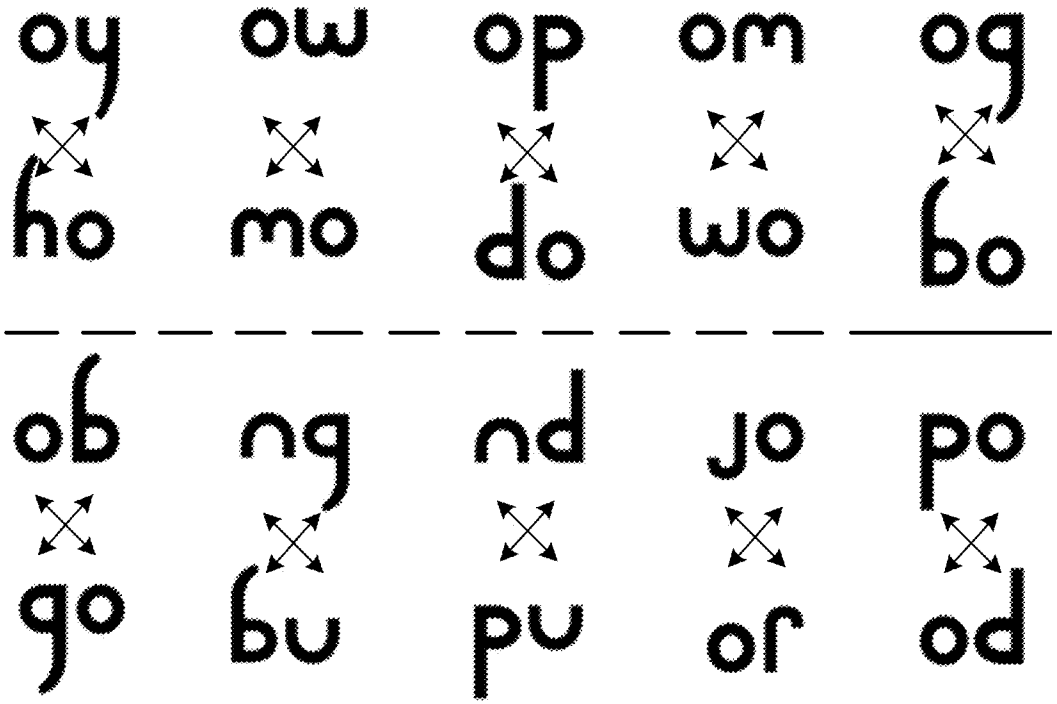
FIG. 5 is a face view of some letter combinations of an exemplary typeface rotated in various orientations, according to an embodiment of the present subject matter.

In some implementations, one or more game pieces 200 may have a typeface indicia comprised of a combination of letters, such as vowel combinations ("ou," "ie," etc.) or digraphs ("ng," "sh," "ch," etc.) or other letter combinations ("nd," "pu," "bu," etc.). As discussed below, and as shown in FIG. 5, combinations of letters may be chosen which do not necessarily have any linguistic connection or logic for their combination, other than that their typographical representation in proximity to one another on a game piece permits rotating of the game piece into two or more orientations or angles, each orientation representing different letter combinations.

Figure 4:
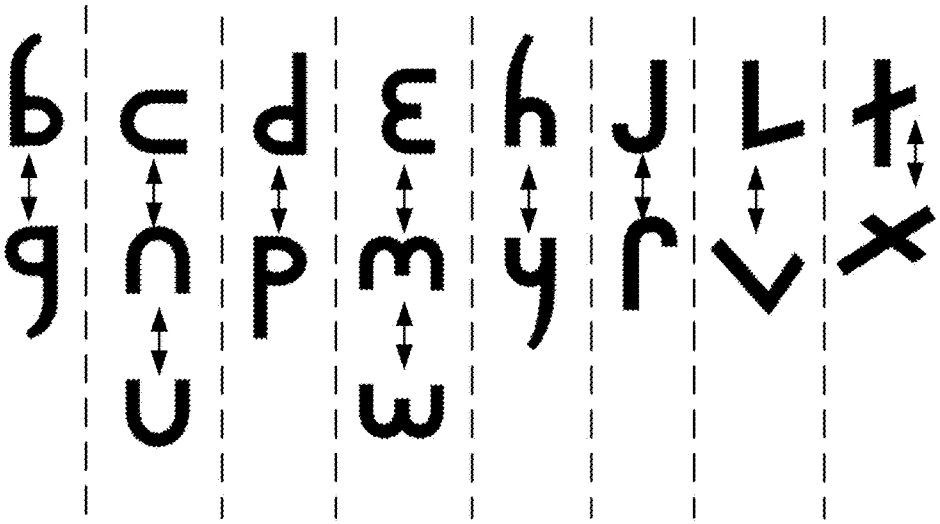
FIG. 4 is a face view of some letters of an exemplary typeface rotated in various orientations, according to an embodiment of the present subject matter.
Figure 6:
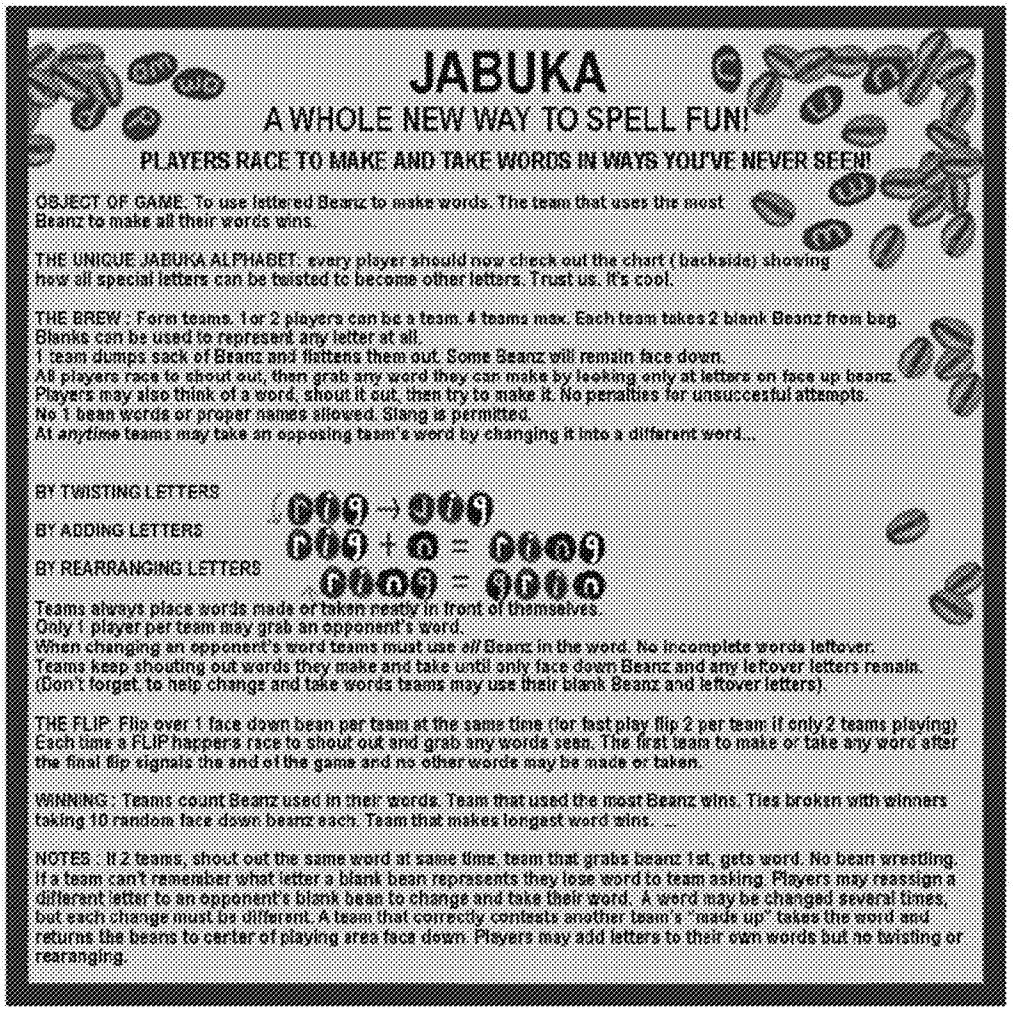
FIG. 6 is an exemplary set of directions to play the game comprising the exemplary game pieces, according to an embodiment of the present subject matter.

In one implementation, the typeface of one or more typeface indicia is either rotatable or non-rotatable. This is to say, that one typeface indicia may be oriented in a plurality of ways, the rotatable indicia depicting a different letter or combination of letters when viewed from different viewing orientations. Furthermore, the typeface indicia may be color coded as such. Additionally, the color code may indicate a score associated with each game piece. Alternatively, each game piece may also indicate value of each game piece which may then be used to determine total score of the word comprised of such game pieces. FIGS. 4, 5 and 6 detail an exemplary typeface according to an embodiment of the present subject matter. Such typeface may be represented as typeface indicia 208 on game pieces 200 to allow word forming in different ways by linearly arranging game pieces 200 next to one another in different orientations. Furthermore, the typeface may include typeface indicia representing both upper case and lower case letters to allow for different possibilities of orientations.

As mentioned before, the exemplary typeface indicia may be rotated or twisted to allow for one typeface indicia to possibly depict different letters depending on how it is oriented relative to a viewer. For example, as shown in FIG. 4, indicia "b" can be rotated to read as both "b" and "g". Therefore, from a first viewing orientation, the indicia depicts "b" and from a second viewing orientation, the indicia depicts "g". As another example, as shown in FIG. 5, game pieces 200 having typeface indicia representing a plurality of letters may also be rotated or oriented in a number of ways to depict a variety of letter combinations.

A plurality of such game pieces 200 may be used to form or create words. A player may form such words on any surface. In some implementations, a gaming board may be provided to linearly arrange the formed words. Some versions of the game may include score sheets for each player to record and score the words formed by each player.

Exemplary methods to play the game are now described in detail. The order in which both the various methods described herein are presented is not intended to be construed as a limitation, and any number of the described method steps can be combined in any order to implement the methods, or an alternative method. Additionally, individual steps may be deleted from or added to the methods described herein without departing from the spirit and scope of the subject matter described herein. Furthermore, the methods can be implemented in any suitable hardware, software, firmware, or combination thereof. The methods may also be taught to a user through written, pictographic, audio or audiovisual instructions.

The game of forming words out of game pieces 200 commences with creation of teams. In alternative versions of the game, a single player may also play following the methods described herein. Each team may comprise one or more players. The method, in one implementation, may include one or more stages. In one example, these stages are referred to as "Brew" and "Flip." In one implementation, the Brew stage includes selecting one or more blank game pieces from amongst a plurality of game pieces 200. In another implementation, the blank game pieces are kept in the same pool as other game pieces and are randomly selected along with other game pieces. As mentioned before, blank game pieces may be used to depict any letter of choice. Furthermore, the indicia of choice may either be rotatable indicia or a non-rotatable one. One of the team players empties the game pieces 200 from the container onto a surface and flattens the game pieces 200. For example, if the game pieces are curved at one end and flat on the other end, flattening may comprise turning the game pieces 200 to their flat sides. Further, a random emptying of game pieces 200 leaves some game pieces facing away from the gaming surface causing the game pieces to reveal the indicia thereon, such game pieces are also referred to as face-up game pieces, while others remain face down with the indicias facing towards the gaming surface and hidden from view. In one implementation, all players look at the face-up game pieces, race to shout out words that can be made from one or more of face-up game pieces with or without the blank game pieces, and then grab the corresponding face-up game pieces to make such words. Alternatively, players may also think of random words, shout them out, and then try to form those words using the face-up game pieces. In other implementations, the players may select a predefined number of game pieces and then attempt to form words using the selected game pieces. As mentioned before, blank game pieces may be used along with other game pieces to form words.

The players may arrange the game pieces forming the words, for example linearly, either on the gaming surface or neatly in front of them. In one implementation, the word-forming game may apply a plurality of restrictions to word selection. For example, the word-forming game may determine the following type of words as illegal: gerunds, prepositions, plurals, any verb other than infinitive, comparative adjectives, abbreviations, prefixes, suffixes which keep the basic connotation unchanged, combined words normally written as two words, etc. In some cases, slangs may be permitted in some embodiments.

In one implementation, teams may take any opposing team's word by changing that word into a different word. For example, a player may change the opponent's word by calling out the word and then rotating, adding or rearranging the linear arrangement of the game pieces as shown by callout 600. The player may select an additional game piece from amongst a set of face-up game pieces and add the additional game piece to a linear arrangement of game pieces forming the existing word. Callout 600 shows examples in ways a second player may modify a word formed by a first player. If a first player forms the word "rig", the second player can twist the letter "r" to form a new word "jig." Alternatively, the second player may add the word "n" and rearrange the letters in "rig" to form a new word "ring." And the first player or another player may rearrange letters of "ring" to form a new word "grin" and so on. In some implementations, the players may only be allowed to add additional game pieces to their own words and restricted from twisting or re-arranging the game pieces in words previously created by them.

In one implementation, the players may use blank game pieces to form words by using opponent's word and/or leftover game pieces. Some implementations may restrict the use of a blank game piece to the letter for which it was first used. Other implementations allow the players to reassign a different letter to a blank game piece that was previously used in a word. If a team cannot remember what letter a blank game piece represents in an already created word, the team can ask the opponent but lose a turn or a word to them. Further, in one implementation, the player may change the blank game piece to represent a different letter than used by the opponent. In another implementation, blank game pieces represent the same letter throughout the duration of a game and may not be changed. In some implementations, the blank piece may be thrown back into the pile of unused game pieces if the team forgets the letter the blank game piece represents. In one implementation, the player may borrow blank game pieces either from the opponent or from the common pool subject to score penalty, etc. Some embodiments may put restrictions on deleting letters from the opponent's word. The foregoing "stealing" of words may continue as long as new and unique words are being created by either of the teams. The players repeat this process of calling out and forming new words or modifying existing words until all face-up game pieces are exhausted or no more words can be created from the left over face-up game pieces. The teams then turn back to the Flip stage.

Figure 7:
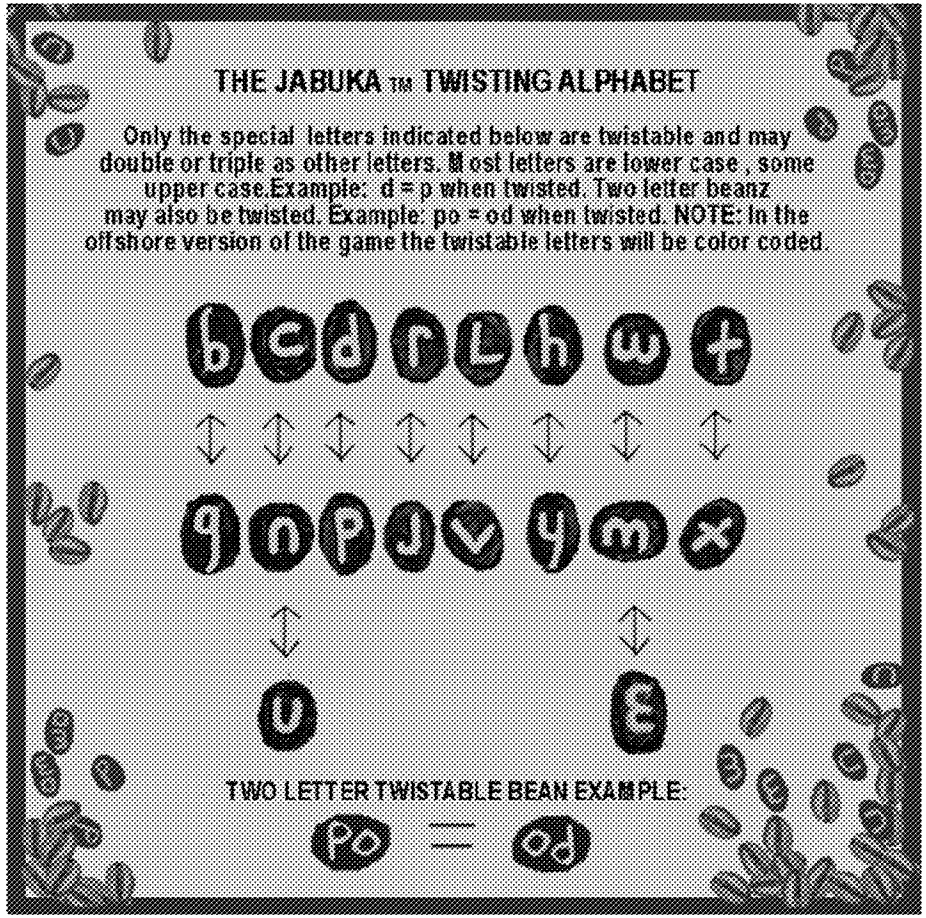
FIG. 7 is an exemplary set of directions explaining rotatable typeface, according to an embodiment of the present subject matter.

In one implementation of the Flip stage, the teams having exhausted all word options with the face-up game pieces in combination with the blank game pieces flip over a predefined number of one or more face-down game pieces at a time so as to reveal the typeface indicia represented thereon, thereby rendering them as face-up game pieces. In some implementations, the teams may flip simultaneously or in a turn-based fashion. Similar to the Brew stage, the teams shout out words and grab any words that can be made from the exposed or face-up game pieces with or without the leftover game pieces from the Brew stage. The teams may word-steal in a manner similar to the Brew stage. In one implementation, the teams continue turning over the face-down game pieces until the last game piece is revealed. In one implementation, the first team to form or take a word after the final flip signals the end of the game and no other words may be made or taken by either of the teams. In another implementation, the teams are allowed to make or steal as many words as they can within a certain time period, time being monitored with the help of, for example, a timer or an hour glass. One such game play method is described in the set of directions shown in FIGS. 6 and 7 and such a set of directions can be included within the container 100.

In another implementation, an additional stage referred to as "Grind" may be included. In one implementation of this stage, either of the teams form words based on exposed typeface indicia in combination with blank game pieces and continue to do so until no words can be created. The teams then flip the face-down game pieces and form more words with the newly flipped game pieces, but word-steal is deferred until the Grind stage. In an example, the Grind stage may begin with starting a preset timer to initiate word-stealing. The players may steal opponent's words using the methods described above.

In another implementation, the game pieces are divided between the teams. A preset timer may then be started to form words from the game pieces in their share. After the time is up, players may play as per the Grind Stage, i.e., steal from opponent's words and make their own by rotating, re-arranging, or adding letters to the opponent's words and/or using leftover words and/or blank game pieces.

In another implementation, all the game pieces 200 are initially placed face-down. Each team then flips over a predefined number of game pieces either simultaneously or in a turn based fashion, and races to make or steal words until all the game pieces 200 have been flipped and/or word forming options have been exhausted.

In another implementation of the game play methods, the teams operate in a turn-based fashion. In one implementation, the first turn may be decided either based on a roll of a die or randomly. The first team selects the game pieces, from amongst the face-up game pieces, and places to spell a word. The first team is followed by the second team and the third team and so on. This process continues through the Brew and Flip stages, or Brew, Flip and Grind stages explained above. In all the foregoing cases, the players may be required to call out the words before placing a new word or modifying existing words.

In another implementation of solo game play method, a single player may empty all the game pieces and start a timer to make as many as words as they can with the help of face-up game pieces and blank game pieces. The words may be written on a score sheet to keep track of all the words created. Optionally, the player may rotate, rearrange or add to their own words as variations. In some embodiments, the player may then flip the face-down pieces and start another timer to create new words.

In one implementation, the game pieces are randomly oriented and may either be face-up or face down. In yet another implementation, the teams dump all the game pieces 200 and take turns to turn over a selected number of face-down game pieces, for example the teams may turn only two game pieces at a time. In another example, all game pieces are made to be either face-up or face-down. All teams then simultaneously start forming one collective crossword by using a selected number of face-up or face-down game pieces. In one implementation, a gaming surface having plurality of rows and columns may be used to arrange the words in a grid-like fashion. For example, the game may be played by calling out a word and joining it to another at right angle or any other angle or orientation possible. If a team makes a word and successfully alters the crossword by methods described above, one or more face-down game pieces may be provided as an incentive or reward. All modification made by either of the teams must work linguistically within the crossword. In this case, the last team to alter the crossword successfully wins.

In one implementation, a winner may be declared at the end of the game. To this end, scoring in the implementations described above may be done in a variety of ways or not at all. In one implementation, a tracking table may be used to record the words formed and/or altered by each of the teams. Furthermore, the tracking table may also map the words with the identity of the player who formed or altered the words. In one implementation, at the end of the game, each team refers to the tracking table and counts the number of game pieces used in the words created or stolen by the team. In another implementation, each typeface indicia or letter may be associated with a value and the overall score of a word can be computed by adding the values associated with identity of all typeface indicia or letters comprising the word. A score sheet may be used to compute a word score associated with each of the words, and then to add the scores corresponding to the formed words to yield a total word score. The team with the highest word score can then be determined as a winner. In another implementation, one word may be worth one point and the team with largest number of words is declared the winner. Alternatively, weights may be assigned to a word based on the length of the word. Therefore, longer words may carry a higher score as compared to words with fewer game pieces or letters.

Scoring may also be affected by one or more of the following cases:

- team asking: if a team cannot remember what letter a blank game piece represents and asks the other team, a score penalty may be applied to the asking team.
- word contest: if a team correctly contests another team's made-up word as incorrect, an additional point is rewarded to the contesting team.
- game piece wrestling: if a plurality of teams shout out the same word at the same time, the team that grabs the first game piece gets credit for the word. The team that initiates wrestling loses a point.
- borrowing game pieces: if a team runs into a deadlock situation, a team may borrow game pieces from an opponent. In some cases, game pieces may be swapped between teams. In either of the cases, points may be deducted from the team needing help.
- timed games: if a team plays the game in a timed set-up, the score may depend on the number of words formed within the pre-defined time period.

The foregoing is considered as illustrative only of the principles of the present subject matter. Further, since numerous modifications and changes will readily occur to those skilled in the art, it is not desired to limit the principles of the present subject matter to the exact construction and operation shown and described, and accordingly, all suitable modifications and equivalents may be resorted to, falling within the scope of the present subject matter. The exemplary methods of game play may be described in the general context of computer executable instructions. Generally, computer executable instructions can include routines, programs, objects, components, data structures, procedures, modules, functions, etc., that perform particular functions or implement particular abstract data types. The methods may also be practiced in a distributed computing environment where functions are performed by remote processing devices that are linked through a communications network. In a distributed computing environment, computer executable instructions may be located in both local and remote computer storage media, including memory storage devices.

Figure 8:
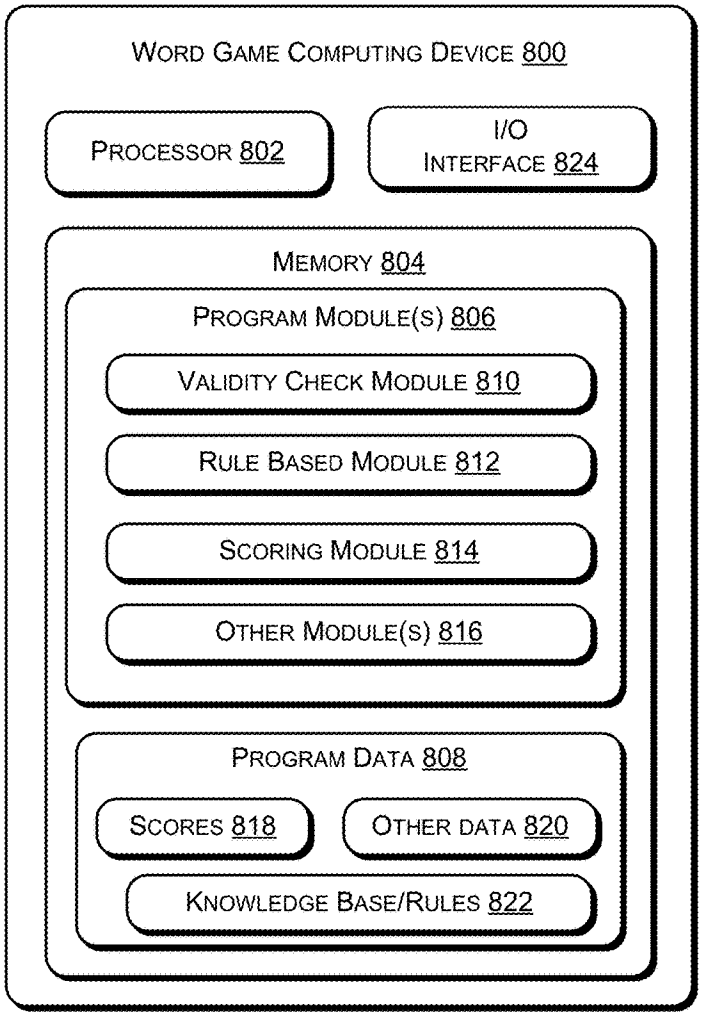
FIG. 8 is a computer systemization for a word-forming game, according to an embodiment of the present subject matter.

For example, while illustrated as a game board or tabletop type word game, the game of the present subject matter, following the same rules explained above, may be implemented on an electronic display, utilizing a computer to implement the game play and scoring methods described above. One such computer implementation is described with reference to FIG. 8. FIG. 8 illustrates an exemplary computing device 800 configured to allow one or more players to generate words from typeface indicia, such as rotatable letters, on one or more computing devices 800, according to an embodiment of the present subject matter. The computing device 800 may be a desktop computer, a hand-held device, a laptop or other portable computer, a mobile phone, a landline phone, a video game system, etc. In case the players are using different computing devices 800, a plurality of diverse or same-type computing devices 800 may communicate based on communication protocols implemented on a communication network (not shown). The communication network may be a wireless or a wired network, or a combination thereof. The communication network can be a collection of individual networks that are interconnected with each other and function as a single large network (e.g., the internet or an intranet). Examples of such individual networks include, but are not limited to, Global System for Mobile Communication (GSM) network, Universal Mobile Telecommunications System (UMTS) network, Personal Communications Service (PCS) network, Time Division Multiple Access (TDMA) network, Code Division Multiple Access (CDMA) network, Next Generation Network (NGN), IP-based network, Public Switched Telephone Network (PSTN), Long Term Evolution (LTE) network, and Integrated Services Digital Network (ISDN), Cloud network, etc.

In an embodiment, the computing device 800 includes a central processing unit, hereinafter referred to as processor 802, and a memory 804. The processor 802 can be a single processing unit or a combination of multiple processing units. The processor 802 may be implemented as one or more microprocessors, microcomputers, microcontrollers, digital signal processors, central processing units, state machines, logic circuitries, and/or any devices that manipulate signals based on operational instructions. Among other capabilities, the processor(s) 802 is configured to fetch and execute computer-readable instructions stored in the memory 804.

The memory 804 may include any computer-readable medium known in the art including, for example, volatile memory such as SRAMs and DRAMs and/or non-volatile memory such as EPROMs and flash memories. The memory 804 includes program module(s) 806 and program data 808. In one implementation, the program module(s) 806 include, for example, validity check module 810, a rule based module 812, a scoring module 814, and other module(s) 816. It will be appreciated that each of the program module(s) 806 can be implemented alone or in a combination of two or more different modules. The other module(s) 816 include programs that supplement applications or functions performed by the computing device 800. For example, the other modules 816 may include a user input module configured to receive inputs from a user. The program data 808 serves, amongst other things, as repository for storing data pertinent to functioning of the program modules 806. For example, program data 808 may include knowledge base 822 to store rules and restrictions on word-forming, and a repository for scores 818 with a mapping table mapping scores to individual players, and other data 820.

In one implementation, the computing device 800 also includes I/O Interface 824. Computer interaction interface elements such as check boxes, cursors, menus, scrollers, and windows (collectively and commonly referred to as widgets) similarly facilitate the access, capabilities, operation, and display of data and computer hardware and operating system resources, and status. I/O Interface 824 is a stored program component that is executed by a CPU. The I/O Interface 824 may be a conventional graphic user interface as provided by, with, and/or atop operating systems and/or operating environments. The user interface may allow for the display, execution, interaction, manipulation, and/or operation of program components and/or system facilities through textual and/or graphical facilities. The I/O Interface 824 provides a facility through which users may affect, interact, and/or operate a computer system. The I/O Interface 824 may communicate to and/or with other components in a component collection, including itself, and/or facilities of the like. Most frequently, the I/O Interface 824 communicates with operating systems, other program components, and/or the like. The I/O Interface 824 may contain, communicate, generate, obtain, and/or provide program component, system, user, and/or data communications, requests, and/or responses. The I/O Interface 824 may be accessed through one or more user input devices (not shown), which are often a type of peripheral device and may include: card readers, dongles, finger print readers, gloves, graphics tablets, joysticks, keyboards, microphones, mouse (mice), remote controls, retina readers, touch screens (e.g., capacitive, resistive, etc.), trackballs, trackpads, sensors (e.g., accelerometers, ambient light, GPS, gyroscopes, proximity, etc.), styluses, and/or the like.

In one implementation, the rule based module 812 in conjunction with the knowledge base 822 implements any of the game plays described above. In one implementation, the user may provide preference to a certain type of game play. Once the game play type is selected, rules corresponding to the selected game play are retrieved from the knowledge base. In one implementation, the rule based module 812 causes the display to display a plurality of game pieces amongst which at least one game piece bears a rotatable indicia. The rotatable indicia, in one implementation, depicts a set of one or more letters when viewed from one viewing angle or orientation and another set of one or more letters, different from the first, when viewed from a second viewing angle or orientation, and so on. Based on the plurality of game pieces presented to the user, the user may form a word using the game pieces. In one implementation, the user input module receives the formed word from one or more players.

In one implementation, the validity check module 810 may be implemented to determine validity of the formed word based on one more predefined validity criteria. For example, the validity check module 810 may automatically check spellings of the words submitted by the player(s) by accessing a dictionary and indicate if any of the words are illegal, for example prefixes or incomplete words. In another example, the validity check module may restrict repetition of words. The players may take formed words, either by themselves or by their opponent, and rotate the typeface indicia to create a new word. To this end, the user input module is configured to receive an indication from a player to rotate the game piece bearing the rotatable indicia. On receiving such an indication, the rule based module 812 allows the user to rotate, add or rearrange the game pieces. For example, the rule based module 812 rotates the display of the game piece bearing the rotatable indicia to a different viewing orientation in accordance with the indication thereby changing the set of one or more letters depicted on the game piece bearing the rotatable indicia. By rotating at least one game piece, the formed word now represents a new word different from the formed word. In some implementations, the team may modify its own words to create a chain of words. A scoring module 814 may be implemented to keep track of words and words modified or words stolen from the opponent, and associate a score with each of the formed words. In some implementations, the scoring module may even prepare a word-tree to track the history of words. As described before, scoring and winning may be based on the total number of virtual game pieces used to create words, length of created words, total number of words created by a team, word scores of all the created words determined based on identity or color code of letters forming the words, etc. The knowledge base 822 may be used to store rules specific to the type of words that may be formed, the scoring methodology, and additional messages, e.g. pop-up messages, to announce events such as end of game, start of game, new record, incorrect word, misspelling, etc. Such messages may be displayed via the I/O Interface 824 and may be done using special graphics and sound effects. In some implementations, the messages may include data obtained from scores 818 or other data 820. The computing device 800 may also keep history of scores associated with a particular player or team for a predefined duration. The scores may also be shared on social networking websites.

Some implementations of the computing device 800 may include a help module (not shown) to provide hints to form words based on the available game pieces, or possible viewing orientations associated with a rotatable indicia on a game piece, etc.

Some implementations of the computing device 800 also exist as web applications that can be run via web browser applications or portals on computing devices 800. Different teams can play by opening the web application on their respective computing devices at the same time. Invitations may be initiated by one of the teams. Such invitations may also be communicated through the use of social networking platforms.

In order to address various issues and advance the art, the entirety of this application (including the Cover Page, Title, Headings, Field, Background, Summary, Brief Description of the Drawings, Detailed Description, Claims, Abstract, Figures, Appendices, and otherwise) shows, by way of illustration, various embodiments in which the claimed present subject matters may be practiced. The advantages and features of the application are of a representative sample of embodiments only, and are not exhaustive and/or exclusive. They are presented only to assist in understanding and teach the claimed principles. It should be understood that they are not representative of all claimed present subject matters. As such, certain aspects of the disclosure have not been discussed herein. That alternative embodiments may not have been presented for a specific portion of the present subject matter or that further undescribed alternate embodiments may be available for a portion is not to be considered a disclaimer of those alternate embodiments. It may be appreciated that many of those undescribed embodiments incorporate the same principles of the present subject matters and others are equivalent. Thus, it is to be understood that other embodiments may be utilized and functional, logical, operational, organizational, structural and/or topological modifications may be made without departing from the scope and/or spirit of the disclosure. As such, all examples and/or embodiments are deemed to be non-limiting throughout this disclosure. Also, no inference should be drawn regarding those embodiments discussed herein relative to those not discussed herein other than it is as such for purposes of reducing space and repetition. For instance, it is to be understood that the logical and/or topological structure of any combination of any program components (a component collection), other components and/or any present feature sets as described in the figures and/or throughout are not limited to a fixed operating order and/or arrangement, but rather, any disclosed order is exemplary and all equivalents, regardless of order, are contemplated by the disclosure. Furthermore, it is to be understood that such features are not limited to serial execution, but rather, any number of threads, processes, services, servers, and/or the like that may execute asynchronously, concurrently, in parallel, simultaneously, synchronously, and/or the like are contemplated by the disclosure. As such, some of these features may be mutually contradictory, in that they cannot be simultaneously present in a single embodiment. Similarly, some features are applicable to one aspect of the present subject matter, and inapplicable to others. In addition, the disclosure includes other present subject matters not presently claimed. Applicant reserves all rights in those presently unclaimed present subject matters including the right to claim such present subject matters, file additional applications, continuations, continuations in part, divisions, and/or the like thereof. As such, it should be understood that advantages, embodiments, examples, functional, features, logical, operational, organizational, structural, topological, and/or other aspects of the disclosure are not to be considered limitations on the disclosure as defined by the claims or limitations on equivalents to the claims. It is to be understood that, depending on the particular needs and/or characteristics of a word game system individual and/or enterprise user, database configuration and/or relational model, data type, data transmission and/or network framework, syntax structure, and/or the like, various embodiments of the word game system may be implemented that enable a great deal of flexibility and customization.

What is claimed is:

1. A method of game play, the method comprising:

obtaining a plurality of game pieces amongst which at least one game piece is a rotatable game piece that bears a rotatable indicia on a face thereof, wherein the rotatable indicia depicts a first letter when the rotatable game piece is positioned in a first orientation and a second letter when the rotatable game piece is positioned in a second orientation;

linearly arranging the game pieces on a gaming surface to form a first word, wherein the first word includes at least one rotatable game piece bearing the rotatable indicia depicting the first letter; and after the game pieces are linearly arranged, rotating the at least one rotatable game piece bearing the rotatable indicia to form a second word different from the first word, wherein the second word includes the second letter in the place of the first letter in the first word.

2. The method of claim 1, wherein the obtaining step further comprises:

distributing a plurality of game pieces on the gaming surface such that a face-up set of game pieces have indicias thereon facing away from the gaming surface and a face-down set of game pieces have indicias thereon facing towards the game surface and hidden from view; and selecting the plurality of game pieces from amongst the face-up set of game pieces.

3. The method of claim 2, further comprising turning over at least one face-down game piece to reveal an indicia thereon and render the face-down piece as one of the face-up set of game pieces.

4. The method of claim 2 further comprising forming a third word, and wherein forming the third word includes:

selecting an additional game piece from amongst the face-up set of game pieces; and adding the additional game piece to a linear arrangement of game pieces forming the first word or the second word.

5. The method of claim 1, wherein the obtaining step further comprises selecting at least one blank game piece to represent an indicia of choice, wherein the indicia of choice is at least one of a rotatable indicia and a non-rotatable indicia, and wherein one or more letters depicted by the indicia of choice are included in the first word and the second word.

6. The method of claim 1 further comprising forming a third word by altering a linear arrangement of the obtained game pieces.

7. The method of claim 1, wherein a first player performs the linearly arranging step to form the first word and a second player performs the rotating step to form the second word.

8. The method of claim 7 further comprising recording each word and an identity of the player associated with its formation.

9. The method of claim 1, further comprising:

assigning a time period to form a word; and determining the score at least in part based on whether the word has been formed within the assigned time period.

10. The method of claim 1, wherein the gaming surface includes a plurality of rows and columns, and wherein the linearly arranging step further comprises:

linearly arranging the game pieces forming the first word on the gaming surface in a crossword fashion along a row or column and arranging any subsequent linear array of game pieces forming a word at right angles to a linear arrangement of game pieces already placed on the gaming surface.

11. The method of claim 1, further comprising determining a score corresponding to one or more of the formed words, wherein the score is determined based on one or more predefined scoring criteria including at least one of: (a) a number of letters forming a word, (b) a total number of formed words, or (c) a total word score determined based on an identity of letters forming a word.

12. The method of claim 1, wherein the rotatable indicia depicts a third letter when the rotatable game piece is positioned in a third orientation that is different from the first orientation and the second orientation and the method further comprises rotating the at least one game piece bearing the rotatable indicia to form a third word different from the first and second words, wherein the third word includes the third letter in the place of the first letter in the first word.

13. A method of game play, the method comprising:

obtaining a plurality of game pieces amongst which at least one game piece is a rotatable game piece that bears a rotatable indicia on a face thereof, wherein the rotatable indicia depicts a first pair of letters when the rotatable game piece is positioned in a first orientation and a second pair of letters when the rotatable game piece is positioned in a second orientation;

linearly arranging the game pieces on a gaming surface to form a first word, wherein the first word includes a rotatable game piece bearing the rotatable indicia depicting the first pair of letters; and after the game pieces are linearly arranged, rotating the rotatable game piece to form a second word different from the first word, wherein the second word includes the second pair of letters in the place of the first pair of letters in the first word.

* * * * *